United States Patent [19]

Stark

[11] Patent Number: 4,668,201

[45] Date of Patent: May 26, 1987

[54] TOY ANIMAL LIFE PRESERVER

[76] Inventor: Richard Stark, 503 Warner St., Lemagne, Pa. 17143

[21] Appl. No.: 728,409

[22] Filed: Apr. 29, 1985

[51] Int. Cl.[4] ..... B63C 9/10

[52] U.S. Cl. ..... 441/88; 441/125

[58] Field of Search ..... 441/88, 112, 125; 446/153, 385, 387, 369; D21/159, 237

[56] References Cited

U.S. PATENT DOCUMENTS

| | | | |
|---|---|---|---|
| 1,310,205 | 7/1919 | Morgenstern | 446/369 X |
| 1,403,434 | 1/1922 | Maroukis | 446/153 X |
| 1,558,200 | 10/1925 | Murphy | 446/153 |
| 1,571,279 | 2/1926 | Lamb | 446/369 |
| 1,851,768 | 3/1932 | Hubbell | 272/1 B |
| 3,460,286 | 8/1969 | Danberg | 446/153 |
| 4,176,772 | 12/1979 | Danon | 441/113 X |
| 4,208,832 | 6/1980 | Corriveau | 446/369 X |
| 4,547,165 | 10/1985 | Scheurer et al. | 441/112 |

*Primary Examiner*—Sherman D. Basinger
*Assistant Examiner*—Paul E. Salmon
*Attorney, Agent, or Firm*—Laurence R. Brown

[57] ABSTRACT

A substantially indestructible, long wearing, life preserver teddy bear toy is constructed with a shaped body of foam plastic enveloped in a tough, snug fitting, water repellant, close fitting fabric outer layer so that the body absorbs less than 5% of its total weight when immersed in water and has enough buoyancy to support a child.

1 Claim, 2 Drawing Figures

TOY ANIMAL LIFE PRESERVER

TECHNICAL FIELD

This invention relates to animal shaped teddy bear type toys and more particularly, it relates to floatable toys that may be used as life preservers.

BACKGROUND ART

One of the prime necessities of the toy art is that toys need be safe for children. Of great concern is the tendency for children to bite off or to eat substances which may be toxic or which are of a size that could choke them. Thus, materials of which the toys are made are critical, as well as construction techniques that make the toys safe.

It is desirable to have toys that are not easily damaged in play. Children can subject toys to many kinds of abuse, such as biting, impact by blunt instruments such as throwing on the floor, penetration of sharp objects such as pencils, and attempting to tear them apart. Thus, a toy preferably has the ability to stand these kinds of abuse.

A toy need be kept sanitary as well, since they frequently end up in the mouth. Thus, they need be washable to remove accumulation of food, dirt, etc. Also, the construction should be inconsistent with bacterial growth.

Teddy bear type toys are lovable and become special as time goes by. Thus, they should have long life without becoming shabby or unkempt. Also, they should be able to go everywhere with their owners, such as in bath tub and swimming pool to share in the fun. This establishes the special requirement that they need to shed water and avoid absorption in order to be useful in or out of the water at any time.

It is particularly appropriate that a beloved toy can be a life saver. This provides a toy role model function by which safety in water may be ingrained. Thus, life preservation qualities in water are desirable so that there is enough buoyancy to support a child in the water. Ordinary life preservers of the inflatable type are dangerous, however, since penetration by a sharp object can immobilize them.

When all the foregoing problems are considered, it has not been feasible heretofore to find any single toy fulfilling all these requirements. There are inflatable toy dolls as in A. E. Murphy U.S. Pat. No. 1,558,200 of Oct. 20, 1925 and other toy shapes as in C. W. Hubbell U.S. Pat. No. 1,851,768 of Mar. 29, 1932 and other stuffed floating toys such as in V. Danberg U.S. Pat. No. 3,460,286 of Aug. 12, 1969. However, as above-mentioned, they are not durable, long life, and safe and could not meet the objectives of this invention.

DISCLOSURE OF THE INVENTION

Thus, the present invention provides a teddy bear having its body formed of shaped closed cell polyethylene plastic foam. The body is enveloped in a snug fitting, tough, water shedding fabric outer layer such as nylon or polypropylene. This provides a toy with enough buoyancy to support a child in the water, and to remain dimensionally stable in water for long periods of time without absorption of any substantial amount of water. The outer fabric protects the toy against disfiguration and fragmentation from tearing, biting, penetration of sharp objects or blows by blunt instruments. The materials are non-toxic, do not easily absorb food or liquids, do not promote growth of bacteria and are easily washed and sanitized. Thus, a long life toy is produced that does not easily become shabby or unkempt.

THE PREFERRED EMBODIMENT

Figure 1:
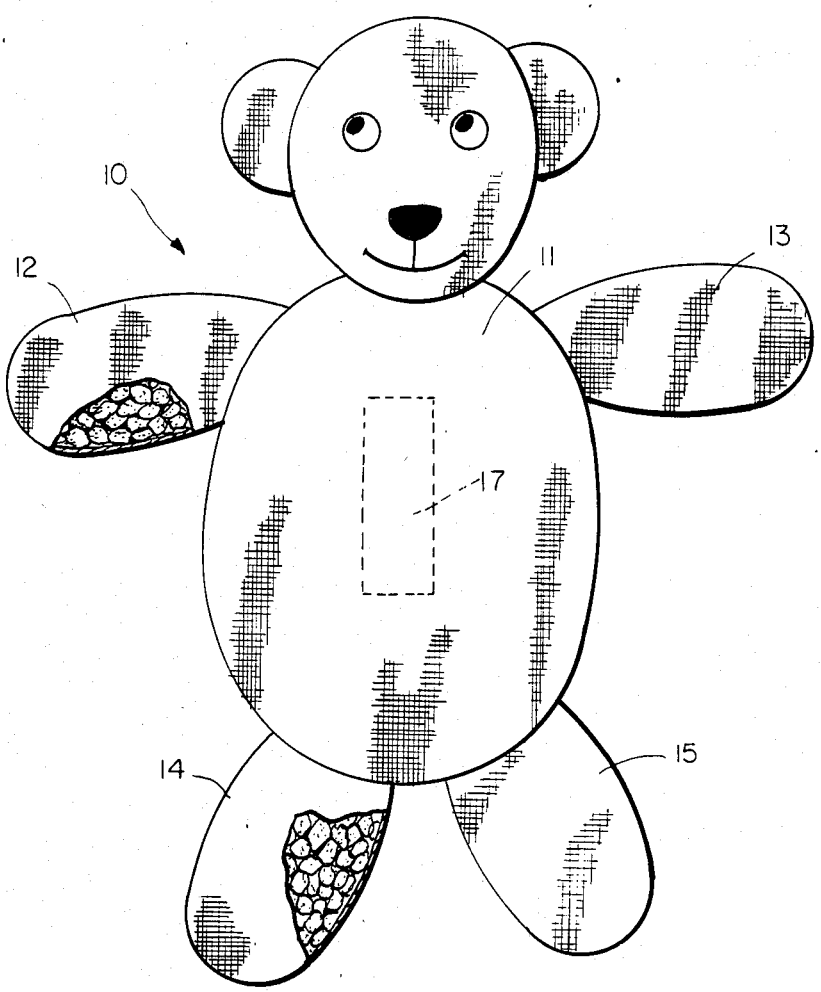
FIG. 1 is a sketch of a typical teddy bear like toy provided by this invention.
Figure 2:
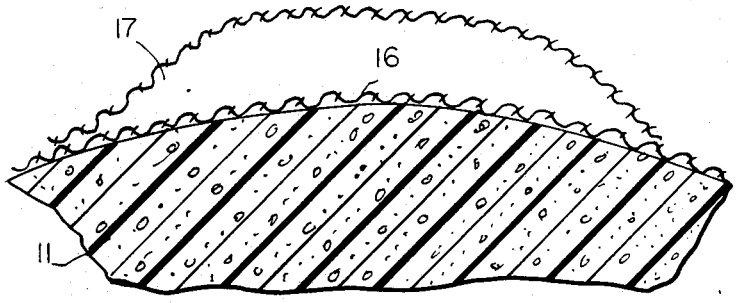
FIG. 2 is a fragmentary view, in cross section, showing the inner plastic foam construction snugly covered by a tough waterproof fabric such as nylon.

The teddy bear type toy 10 of FIG. 1 has any desired specific shape or styling that would produce a desirable toy for a child. In general, it has a main body portion 11 and a set of limbs 12 to 15. In accordance with this invention, the critical manner of construction and materials are referenced to the view of FIG. 2.

Thus, the body portion 11 is an appropriately shaped mass of foam plastic, preferably closed cell polyethylene. This is non-toxic, light enough to make the toy a life preserver with enough buoyancy in the water to support a child's weight and fully waterproof to avoid water absorption, change of shape or deterioration in the water even for long time periods. However, this body portion alone has the tendency to fragment or be disfigured if bitten, torn or impacted with instruments of various shapes. Thus, a child could bite off a chunk just large enough to choke on, the toy would tend to lose its appeal by becoming shabby or unkempt, and the life of the toy would be seriously limited.

However, with a tough, snug fitting, water repellant, outer fabric covering layer 16, typically 100% nylon or 100% polypropylene, enveloping the body portion, the foregoing objectives of this invention are attained. Food, moisture or bacterial accumulation is not encouraged, the shape is preserved against biting and impact, and the toy may be washed or used in the water without absorbing water and necessitating drying.

For carrying the toy, an arm receiving band or strap 17 of nylon fabric, or the like, may be provided at the back of the toy. This is particularly helpful for retaining a grip on the toy in the water when used as a life preserver.

If it is desirable to have movable limbs 12 to 15, this may conveniently be provided by filling the fabric envelope with foam particles in the various limb appendages, thereby giving a degree of movement and flexibility without detracting from other features and advantages of the toy. Other types of leg movement joints may be provided as desired.

With these materials the toy absorbs less than 5% of the total weight of the body when immersed in water. The foam absorbs no water, polypropylene fabric 1% by weight and nylon fabric 7% by weight. There will be no rot or deterioration in any kind of environment, and is as adaptable to salt water as fresh water.

Having therefore advanced the state of the art, those novel features believed descriptive of the nature and spirit of the invention are defined with particularity in the following claims.

I claim:

1. A safe, waterproof toy animal floatable as a life preserver, comprising in combination, an animal shaped body having a torso formed substantially integrally of a closed cell polyethylene plastic foam with a tough, snug fitting, water repellant, fabric covering layer and having movable limbs each formed of foam particles with a tough, snug fitting, fabric covering layer, such that the body absorbs less than 5% of its total weight when immersed in water, has enough buoyancy to support a child in the water, is dimensionally stable in water for long periods of time, retains its buoyancy when subjected to hard wear, penetration by a sharp object and impact by blunt instruments, and resists disfiguration or fragmentation from tearing or biting, thereby to avoid danger of choking swallowing or reduction of buoyancy and to have a long carefree life, and an arm strap of nylon on the back of the toy animal through which the arm of a child may pass for securing the life preserver to the child.

* * * * *

UNITED STATES PATENT AND TRADEMARK OFFICE

CERTIFICATE OF CORRECTION

PATENT NO. : 4,668,201

DATED : May 26, 1987

INVENTOR(S) : Richard Stark

It is certified that error appears in the above-identified patent and that said Letters Patent is hereby corrected as shown below:

ON TITLE PAGE:

Change the inventor's address to:

503 Warren Street
Lemoyne, PA 17043

Signed and Sealed this

Tenth Day of March, 1992

*Attest:*

HARRY F. MANBECK, JR.

*Attesting Officer*

*Commissioner of Patents and Trademarks*